US005247919A

United States Patent [19]

Akaki et al.

[11] Patent Number: 5,247,919

[45] Date of Patent: Sep. 28, 1993

[54] IGNITION SYSTEM FOR AN ENGINE

[75] Inventors: Motonobu Akaki, Anjo; Nobuyuki Oota, Kariya; Yasutoshi Yamada, Aichi, all of Japan

[73] Assignee: Aisin Seiki Kabushiki Kaisha, Kariya, Japan

[21] Appl. No.: 851,002

[22] Filed: Mar. 12, 1992

[30] Foreign Application Priority Data

Mar. 12, 1991 [JP] Japan ..... 3-70305

[51] Int. Cl.[5] ..... F02P 9/00

[52] U.S. Cl. ..... 123/606; 123/625; 123/640

[58] Field of Search ..... 123/425, 625, 626, 606, 123/607, 637, 640

[56] References Cited

U.S. PATENT DOCUMENTS

| | | | |
|---|---|---|---|
| 3,828,752 | 8/1974 | Hioki et al. | 123/640 |
| 3,945,362 | 3/1976 | Neuman et al. | 123/606 |
| 4,183,340 | 1/1980 | Gilbert | 123/606 |
| 4,350,137 | 9/1982 | Yoshinaga et al. | 123/425 |
| 4,653,459 | 3/1987 | Herden | 123/637 |
| 4,938,200 | 7/1990 | Iwasaki | 123/620 |
| 5,038,744 | 8/1991 | Martin et al. | 123/625 |
| 5,097,815 | 3/1992 | Oota et al. | 123/606 |
| 5,140,970 | 8/1992 | Akaki et al. | 123/620 |

FOREIGN PATENT DOCUMENTS

| | | | |
|---|---|---|---|
| 55-60664 | 5/1980 | Japan . | |
| 60-50273 | 3/1985 | Japan | 123/640 |

*Primary Examiner*—Andrew M. Dolinar

*Attorney, Agent, or Firm*—Oblon, Spivak, McClelland, Maier & Neustadt

[57] ABSTRACT

An ignition system has a burn sensor detects the condition of the burn of the fuel so that the ignition system stops supplying the current to the ignition plug when the burn of the fuel is detected. On the other hand, if the burn of the fuel is not sufficient, the ignition system keeps supplying the current to the ignition plug to make sure the burn to happen. Thus the ignition system can develop the energy efficiency and consumption.

5 Claims, 4 Drawing Sheets

IGNITION SYSTEM FOR AN ENGINE

BACKGROUND OF THE INVENTION

1. Field of the Invention

The present invention relates to an ignition system for an automobile engine.

2. Description of the Prior Art

A conventional multi-ignition system supplies ignition currents to the ignition plug many times in a certain period of time in which it responds to an ignition timing signal. This prevents the ignition from misfire and knocking by applying a high voltage power many times. This kind of multi ignition system uses a timer to control the multi-ignition signal. This system detects a current of the primary coil of an ignition coil to check the magnetic electric energy of the coil. The system discharges the energy when a detected current shows a completion of a charge. However, the multi-ignition system keeps supplying the ignition currents repeatedly even when the burn of the fuel is conducted properly. This wastes of energy and fuel efficiency. Further, the condition of the combustion chamber may vary with respect to the driving condition, the pressure of the chamber, the temperature, the revolution and the engine load. In order to cover all conditions, a time for supplying the ignition current is set as a long time. This consumes more energy.

SUMMARY OF THE INVENTION

Accordingly, one of the objects of the present invention is to produce an ignition system to obviate the above drawbacks.

Another object of the present invention is to produce an ignition system which has a higher energy efficiency.

To achieve the above objects, and in accordance with the principles of the invention as embodied and broadly described herein, an ignition system for an automobile comprises a spark plug, ignition timing means for providing an ignition timing signal, ignition current supply means for supplying a current to the spark plug in response to said ignition timing signal, a burn sensor for detecting a condition of the burn and control means for stopping supplying the current to the spark plug when the burn sensor detects the burn of the fuel.

In accordance with the above mentioned ignition system, the burn sensor detects the condition of the burn of the fuel so that the ignition current supply means stops supplying the current to the ignition plug when the burn of the fuel is detected. On the other hand, if the burn of the fuel is not sufficient, the ignition current supply means keeps supplying the current to the ignition plug to make sure the burn occurs. Thus the ignition system can develop the desired energy efficiency and consumption.

BRIEF DESCRIPTION OF THE DRAWING

For a full understanding of the true scope of the invention, the following detailed description should be read in conjunction with the drawing, wherein.

DETAILED DESCRIPTION OF THE PREFERRED EMBODIMENTS

In the following, preferred embodiments of the present invention will be described with reference to the drawings.

Figure 1:
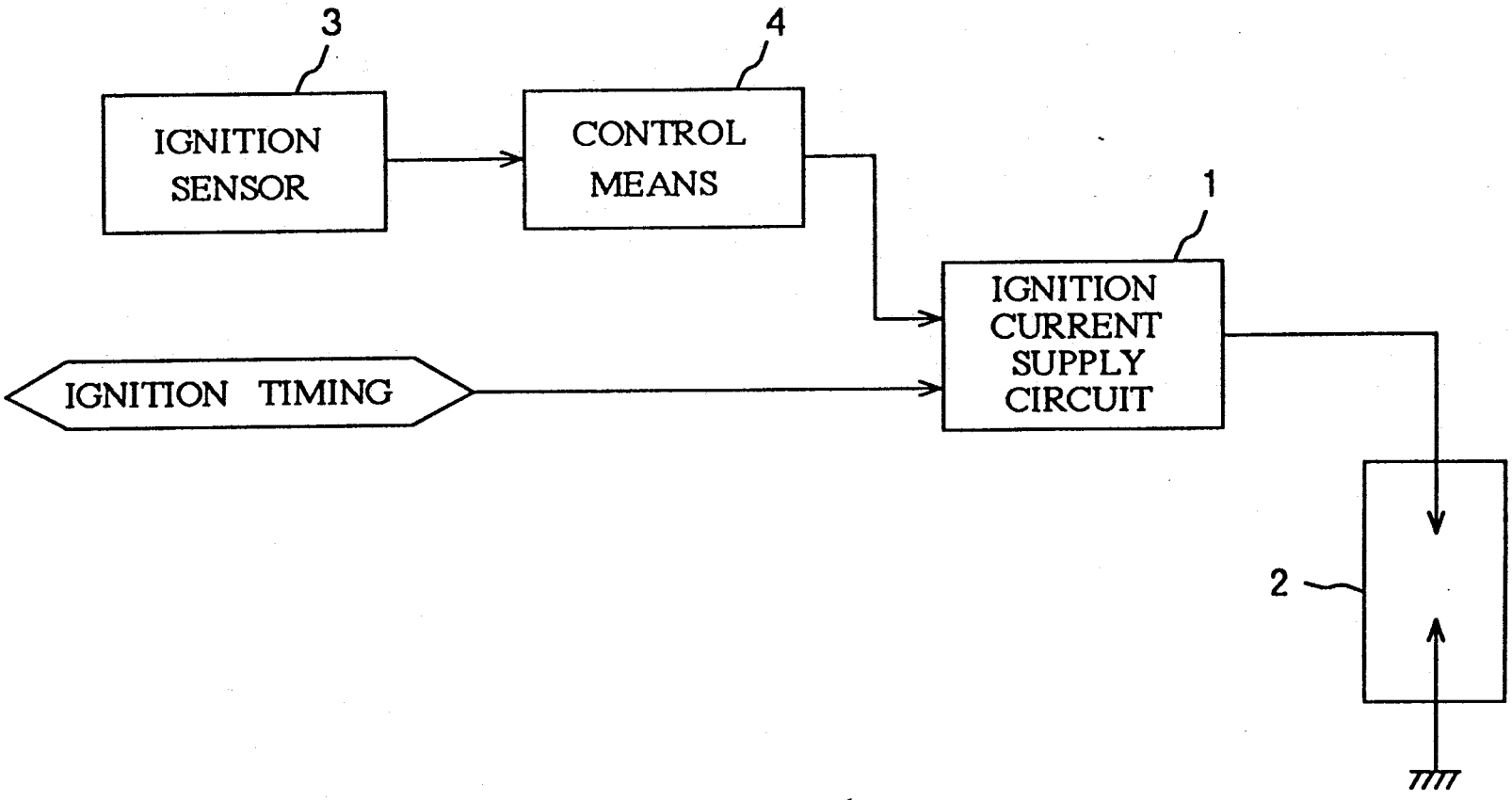
FIG. 1 is a block diagram which shows a circuit of an ignition system of the present invention.

FIG. 1 shows a circuit of an ignition system of the present invention. An ignition current supply circuit 1 supplies the ignition current to spark plugs 2 in response to the ignition timing signal. The ignition current supply circuit 1 repeats or holds the current supply within the period of the ignition timing signal. A burn sensor 3 detects a condition of the burn of the fuel in the combustion chamber. A control circuit means 4 sends the signal to stop supplying the ignition current supplied by the ignition current supply circuit 1 when the burn sensor 3 detects the burn of the fuel.

Figure 2:
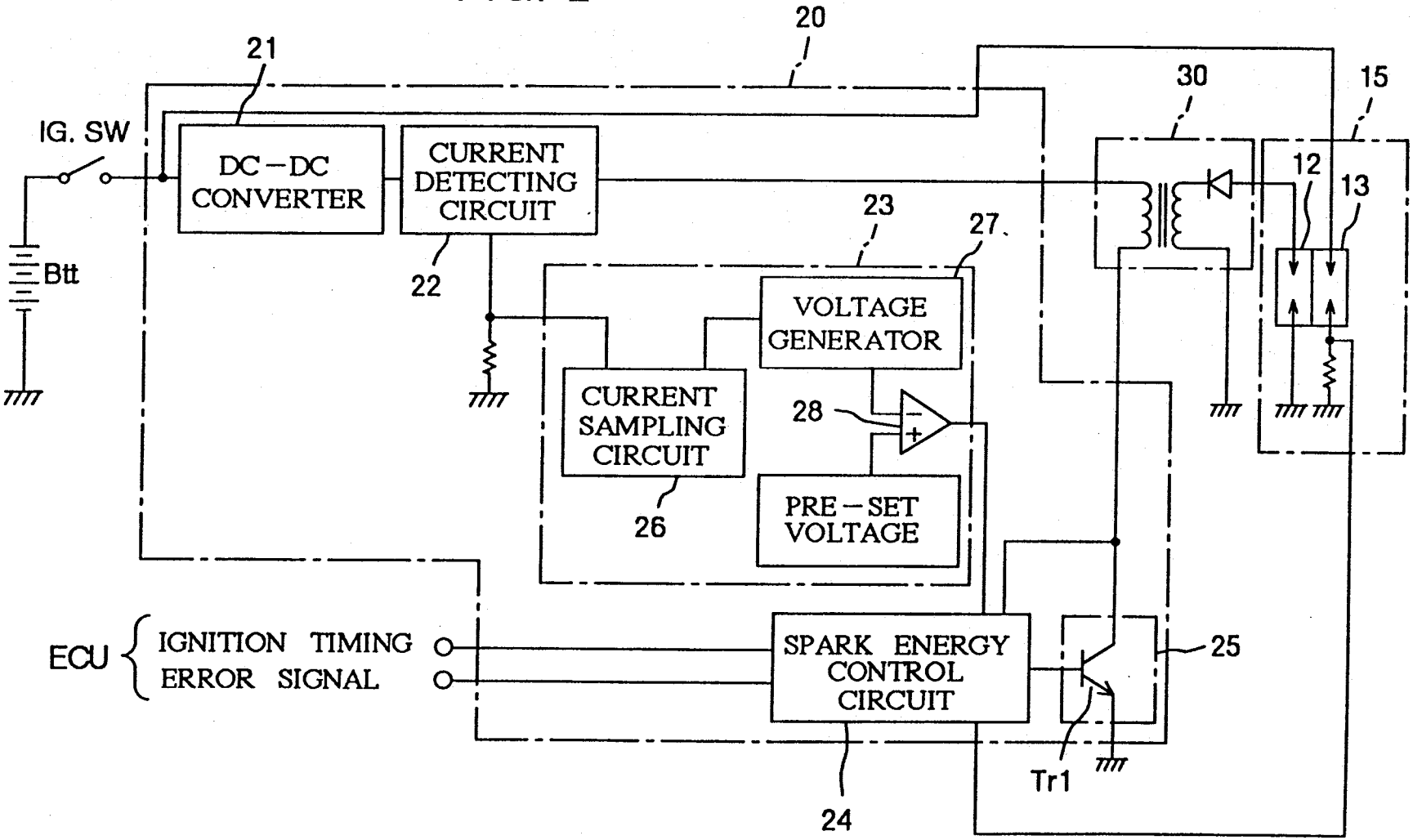
FIG. 2 is a diagram which shows a circuit of the first embodiment of the present invention.

FIG. 2 is a diagram which shows a circuit of the first embodiment of the present invention. Referring to FIG. 2, the ignition system comprises the controller 20, the ignition coil 30, the spark plug 12 and the ion sensor 13. The controller 20 is connected to the battery Btt through the ignition switch IG.SW. The power is supplied to the DC-DC converter 21 which is connected to the ignition coil 30. The current detecting circuit 21 is connected between the DC-DC converter 21 and the ignition coil 30. The current detecting circuit 21 is further connected to the time setting circuit 23. The time setting circuit 23 is connected to the spark energy control circuit 24. The spark energy control circuit 24 receives the signals from the ion sensor 13 and sends the control signal to the transistor Tr1 of the driver circuit 25. The time setting circuit 23 comprises the current sampling circuit 26, the voltage generator 27 and the comparator 28. The current sampling circuit 26 samples the current signal of the current detecting circuit 22 when the predetermined period of time has passed after supplying the current to the ignition coil 30. The voltage generator 27 detects the rise time of the primary coil current. The signal corresponding to the rise time is compared with the preset voltage by the comparator 28. The current level which starts the supply to the ignition coil 30 depends on the magnetic energy stored in the ignition coil 30. A time for charging the ignition coil 30 is calculated.

Figure 4:
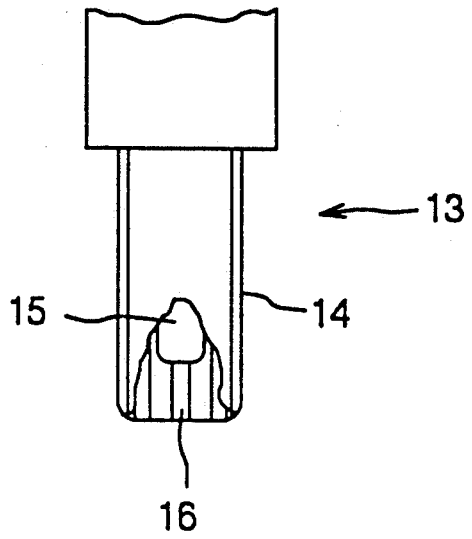
FIG. 4 is a side view of the ion sensor of the present invention.
Figure 5:
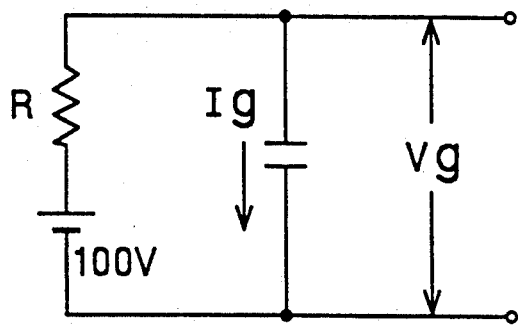
FIG. 5 is a drawing which shows a circuit of the ion sensor.

The spark energy control circuit 24 turns on the driver circuit 25 to supply the current to the primary coil of the ignition coil 30 in response to the ignition timing signal. The time setting circuit 23 sets a time for supplying the current and after such time has passed the time setting circuit 23 turns off the driver circuit 25. When the current to the ignition coil 30 is shut off, an ignition current provided by the secondary coil of the ignition coil 30 is supplied to the ignition plug 12 to spark. A time for the spark is set to a predetermined time. After the predetermined time, the spark energy control circuit 24 turns the driver circuit 25 on again to supply the current to the ignition plug 12. This repeats many times while the ignition timing signal exists. This prevents the plug from misfire. When the ion sensor 13 detects the burn of the fuel, the spark energy control circuit 24 stops supplying the current to the ignition coil 30. The spark energy control circuit 24 repeats till the ion sensor 13 detects the burn. The spark energy control circuit 24 sends an error signal if the ion sensor 13 detects an error of the spark signal. FIGS. 4 and 5 shows the ion sensor 13. The ion sensor 13 is a plug which has an outer electrode 14 and an inner electrode 16 supported by the insulating material. The height of the sensor is about 10 mm. The ion current is about 10 $\mu$A and is detected by the circuit shown in FIG. 5. The ion plug is placed as far as possible from the spark plug.

Figure 3:
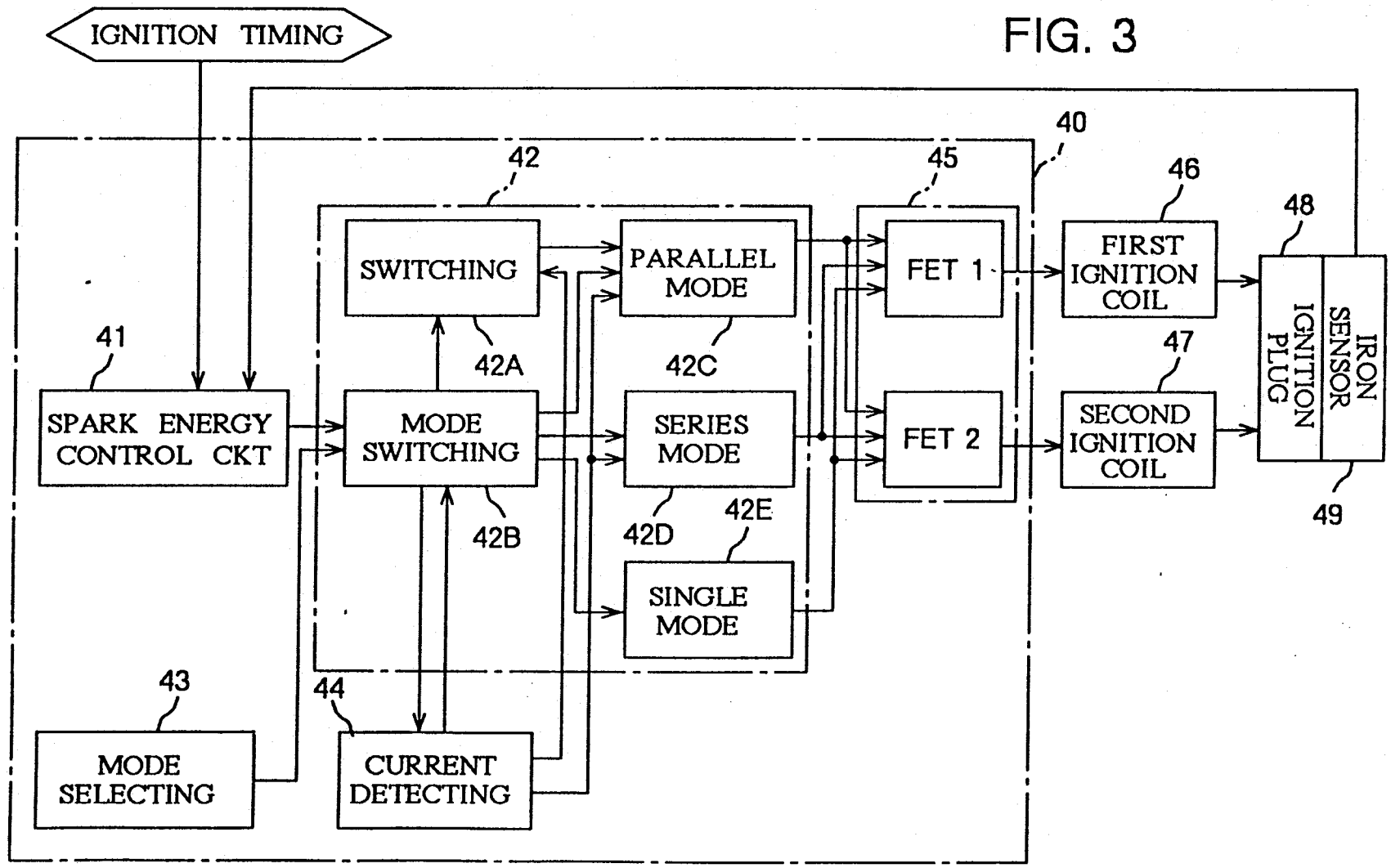
FIG. 3 is a diagram which shows a circuit of the second embodiment of the present invention.

FIG. 3 is a diagram which shows a circuit of the second embodiment of the present invention. Referring to FIG. 3, The multi-ignition system has the control circuit 40, two ignition coils 46, 47, the ignition plug 48 and the ion sensor 49. The control circuit 40 includes two output transistors FET 1 and FET 2 to supply the current for multi-ignition system. The control circuit 40 has the spark energy control circuit 41, the mode switching circuit 42 which changes the modes of the two ignition coils 46, 47, the mode selecting circuit 43 to select the current shape supplying to the ignition plug 48, the current detecting circuit 44 to detect the currents supplied to the ignition coils 46, 47 and the output control circuit 45 which has two transistors FET 1, FET 2. The ion sensor 49 is connected to the control circuit 40. In this embodiment, the control circuit 40 can control the two transistors FET 1, FET 2 and the two ignition coils 46, 47 independently. The system has three modes such as a parallel mode 42C, a series mode 42D and a single mode 42E. The system can get a stronger ignition current in the parallel mode. The system can get a continuous ignition current in the series mode. In the single mode, the system is in an energy efficient condition. The system is also in the single mode when one of the two ignition systems is down. The modes can be selected by the mode selecting circuit 43 by the driver while the system has an auto selecting function. In winter or a cold condition, the mode switching circuit 42B selects the parallel mode circuit 42C to obtain a stronger ignition current. When the driving goes into a stable condition, the system controls the ignition in accordance with the signal of the ion sensor 49. If the fire is correct and the signal from the ion sensor 49 is big enough, the system selects the single mode. If the signal from the ion sensor 49 is small, the system selects the series mode by the series mode circuit 42D. When the system is in either the parallel mode or in the series mode, the system can obtain a quick ignition current to the coils. This can prevent the knocking. In the single mode the system saves energy.

The ion sensor is known to have a characteristics which shows a big output current change when the knocking occurs. When a output current change is detected by the ion sensor, the system sets the overrun period for two output currents to ignition plug 48 in the parallel mode so that the system can supply a stronger ignition current to the plug.

In the embodiments of the present invention, the system uses the ion sensor for a burn sensor which, but 1 pressure sensor detects the pressure of the combustion chamber may instead be used. The signal of the pressure sensor is differentiated to detect a pressure rise in the beginning of the burn. The optical sensor to detect the light of the burn can be used as well.

The invention has been described in an illustrative manner, and it is to be understood that the terminology which has been used in intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A multi-ignition system for an automobile comprising:

an ignition coil having a primary coil and a secondary coil;

a spark plug connected in series to the secondary coil;

ignition timing means for providing an ignition timing signal;

ignition control means for producing multi-ignition currents in the secondary coil within a time period by means of supplying charging currents to the primary coil intermittently in response to said ignition timing signal;

a burn sensor for detecting a condition of burn of the fuel; and stopping control means for stopping supply of the charging currents to the primary coil via the ignition control means when the burn sensor detects the burn in the time period.

2. The system of the claim 1 further comprising another ignition coil having a primary coil and a secondary coil.

3. The system of claim 2 further comprising a control circuit for supply current to the ignition coils in parallel.

4. The system of claim 2 further comprising a control circuit for supply current of the ignition coils in series.

5. The system of claim 2, further comprising a control circuit for selectively supplying current to the ignition coils in one of a series mode, a parallel mode and a single mode.

* * * * *